United States Patent [19]

Alcock et al.

[11] 4,099,403

[45] Jul. 11, 1978

[54] IN-LINE WIRE DRAWING MACHINE

[75] Inventors: Richard A. Alcock; Robert M. Guthrie, both of Rockford, Ill.

[73] Assignee: Rockford Manufacturing Group, Inc., Rockford, Ill.

[21] Appl. No.: 772,522

[22] Filed: Feb. 28, 1977

[51] Int. Cl.[2] ..... B21C 1/12

[52] U.S. Cl. ..... 72/288; 72/289

[58] Field of Search ..... 72/278, 279, 280, 288, 72/289, 17

[56] References Cited

U.S. PATENT DOCUMENTS

| | | | |
|---|---|---|---|
| 3,280,611 | 10/1966 | Lathom et al. | 72/289 |
| 3,339,396 | 9/1967 | Carlson | 72/289 |
| 3,402,588 | 9/1968 | Guthrie | 72/289 |
| 3,646,798 | 3/1972 | Alcock | 72/289 |
| 3,709,021 | 1/1973 | Jackman | 72/289 |

*Primary Examiner*—Michael J. Keenan

*Attorney, Agent, or Firm*—Leydig, Voit, Osann, Mayer & Holt, Ltd.

[57] ABSTRACT

The drum of an in-line wire drawing machine is rotated by a mechanical variable speed drive whose speed is automatically adjusted by a speed trim control which senses the difference between the speed of the wire being supplied by the drum and the speed at which wire is being consumed by a using station. The final wrap of wire on the drum is engaged by a roller connected to a one-way clutch, the roller serving to prevent the wire from slipping on the drum and thus serving to increase the traction between the wire and the drum.

6 Claims, 4 Drawing Figures

IN-LINE WIRE DRAWING MACHINE

BACKGROUND OF THE INVENTION

This invention relates to an in-line wire drawing machine of the type which pulls a length of wire through a drawing die and supplies the wire to a using station where a production machine such as a cold header performs an operation on the wire. More particularly, the invention relates to a wire drawing machine of the same general type as disclosed in Lathom et al U.S. Pat. No. 3,280,611; Guthrie U.S. Pat. No. 3,402,588 and Alcock U.S. Pat. No. 3,646,798.

In such a wire drawing machine, a coil of wire is wrapped around a rotatable drum. When the drum is rotated, wire is drawn through the die and wound onto one end of the drum and, at the same time, wire is unwrapped from the other end of the drum and is delivered to the production machine. The speed of rotation of the drum must be matched to the demand of the production machine and, for this purpose, the drum is rotated by a variable speed drive mechanism which may be adjusted manually to cause the drum to rotate at a selected speed. In those instances where the variable speed drive mechanism is of the mechanical type, provision is made to momentarily shut off the drive motor when the drum is supplying more wire than can be consumed by the production machine. If the drive mechanism is of the hydrostatic type or if the drive mechanism incorporates a slip clutch, provision is made to automatically trim the speed of the drum in order to equalize the supply of wire with the requirements of the production machine. To stop the drum or adjust its speed, a pivoted compensator arm is biased into engagement with a loop of wire after the wire leaves the drum. When the speed of the drum is too great, the size of the loop increases and the arm swings in one direction to either shut off or slow down the drive to the drum. If there is an insufficient supply of wire, the loop decreases in size and causes the arm to swing in the opposite direction so as to either restart the drive or increase its speed.

It is desirable to obtain maximum traction between the wire and the drum in order to develop sufficient force to pull the wire through the drawing die and to prevent the wire from slipping on and galling the drum. Also, it is desirable that the wire leave the drum with minimum tension so that the wire will not pull back on the production machine. Prior arrangements for achieving these aims, however, are both complicated and expensive.

SUMMARY OF THE INVENTION

One of the important objects of the present invention is to provide a new and improved wire drawing machine having a variable speed drive which is of the comparatively simple and inexpensive mechanical type and which is adapted to be automatically adjusted to trim the speed of the drum so as to avoid the need for repeatedly stopping and starting the drive and also to allow the wire to leave the drum with very little tension.

A more detailed object is to provide a wire drawing machine which employs a commercially available variable speed drive having pulleys whose effective diameters may be adjusted to change the speed of the drive, one of the pulleys being adjusted automatically by the compensator arm when the latter senses a change in the exiting speed of the wire.

Another important object is to provide a simple and low cost roller which holds the final wrap of wire against the drum and which prevents the wire from slipping on the drum so as to increase the traction between the wire and the drum.

The invention also resides in the use of a one-way clutch in conjunction with the roller, the clutch permitting the roller to rotate in a direction allowing wire to be removed from the drum but preventing the roller from rotating in the opposite direction and thereby preventing slippage of the wire on the drum.

These and other objects and advantages of the invention will become more apparent from the following detailed description when taken in conjunction with the accompanying drawings.

DETAILED DESCRIPTION OF THE PREFERRED EMBODIMENT

Figure 1:
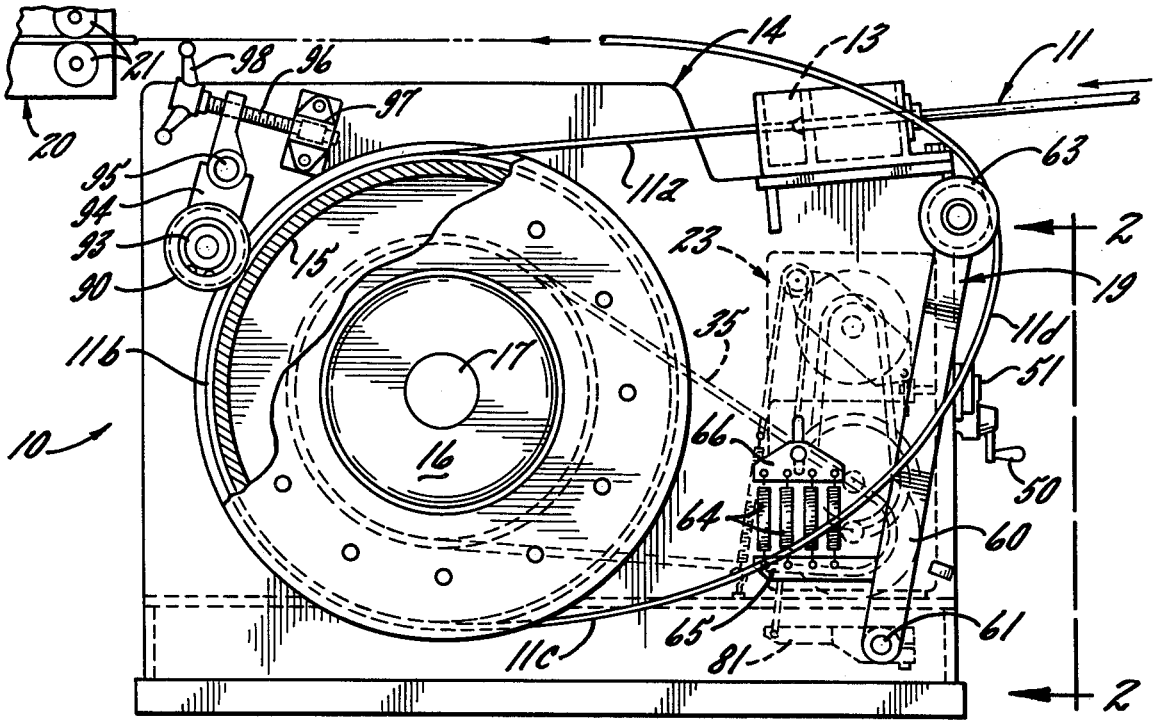
FIG. 1 is a side elevational view of a new and improved wire drawing machine incorporating the unique features of the present invention, parts of the machine being broken away and shown in section.

As shown in the drawings for purposes of illustration, the invention is embodied in a machine 10 for pulling a length of wire 11 through a drawing die 13 which serves to reduce the diameter of the wire. The drawing die is secured to the main support or frame of the machine, the frame being indicated generally by the reference numeral 14.

To pull the wire 11 through the die 13, the machine 10 includes a capstan or drum 15 secured to a torque hub 16 and adapted to be rotated about a horizontal axis defined by the axis of a shaft 17 whose ends project outwardly from the hub and are suitably journaled by the frame 14. When the drum 15 is rotated, an entering length of wire **11*a* is pulled onto one end portion of the drum (hereinafter called the entrance end portion) and the wire is wound in a coil 11*b* around the drum, the coil being composed of a number of wraps in a single layer. At the other end portion of the drum (hereinafter called the exit end portion), an exiting length of wire 11*c* is uncoiled from the drum and is formed into a loop 11*d* by a sensing or compensating arm 19 whose structure and function will be described subsequently. After looping around the compensating arm, the wire is supplied to a using station 20 where apparatus such as a further drawing die, a wire straightener, a wire winding machine, a cold header or other production machine may be located. In the present instance, it may be assumed that a cold header is located in the using station 20 and that the wire 11 is drawn off of the drum and supplied to the cold header by a pair of intermittently rotatable feed rolls 21**.

The drum 15 is rotated by a variable speed mechanical drive mechanism 23 which preferably but not necessarily is of the commercially available type such as that sold under the trademark U. S. Varidrive by Emerson Electric Co. of Milford, Connecticut. Such a drive mechanism is mounted on the frame 14 and includes an electric motor 24 (FIG. 2) having a drive shaft 25 which supports a pulley 26 whose effective diameter may be adjusted. The pulley 26 is connected by an endless belt 27 to a similar adjustable pulley 29 mounted on a shaft 30 which serves to drive a speed reducer 31. The output shaft 34 of the speed reducer is connected by an endless belt 35 and by pulleys 36 and 37 to the shaft 17 of the drum 15.

Figure 2:
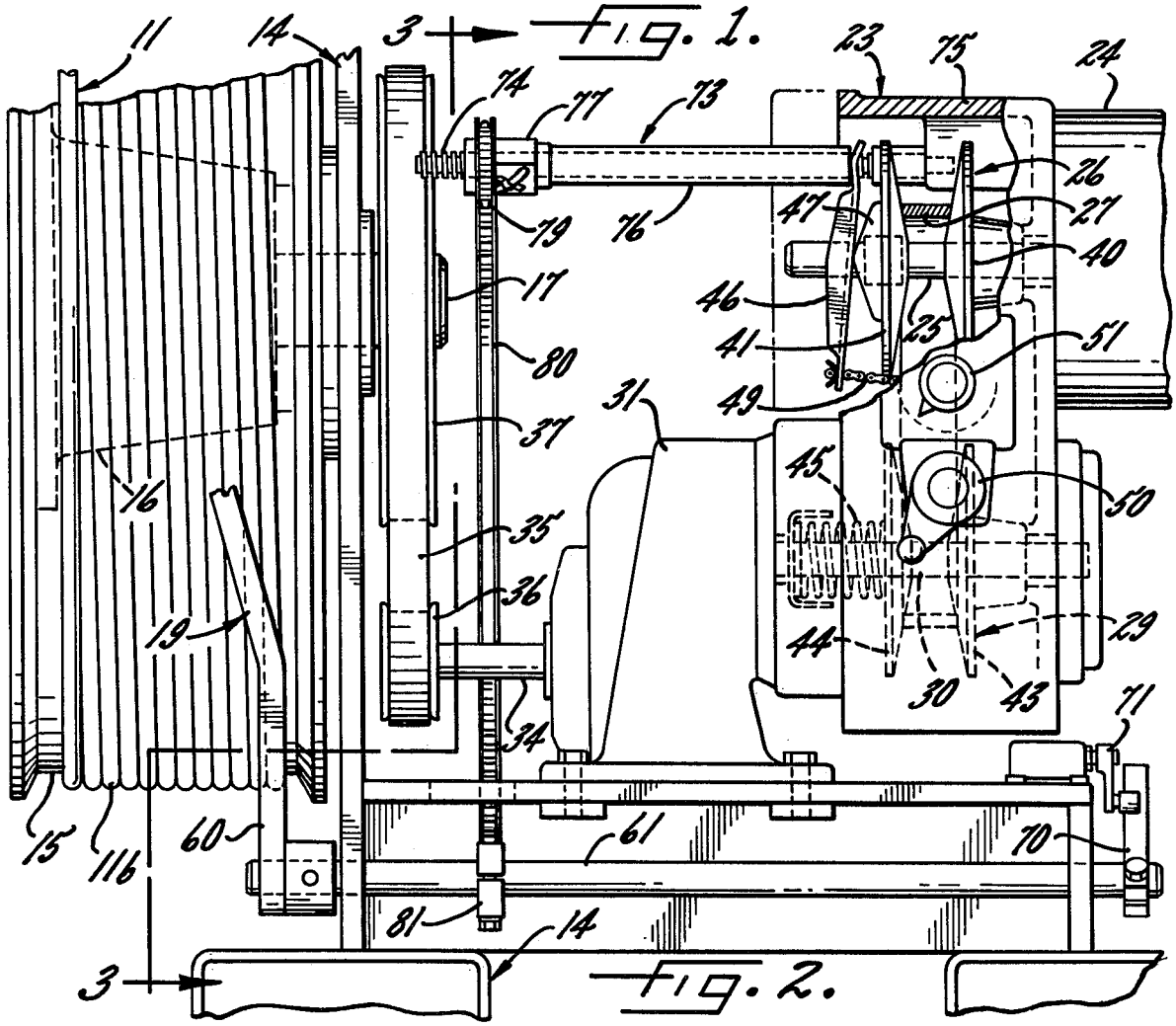
FIG. 2 is an enlarged view taken substantially along the line 2—2 of FIG. 1 and showing certain parts of the machine in section.

As shown in FIG. 2, the pulley 26 includes an axially fixed disc 40 and further includes a second disc 41 which is mounted slidably on the shaft 25 so as to slide toward and away from the disc 40. Similarly, the pulley 29 includes an axially fixed disc 43 and an axially slidable disc 44, the slidable disc being biased toward the fixed disc by a coil spring 45 which is telescoped over the shaft 30.

Means are provided to enable the effective diameters of the pulleys 26 and 27 to be adjusted manually by the operator of the machine 10 so that the operator may establish a selected speed of rotation for the drum 15. Herein, these means comprise a shifting lever 46 (FIG. 2) which rotatably receives the shaft 25 and which is mounted on the shaft to rock about an axis extending perpendicular to the shaft. The upper end portion of the lever 46 normally is held in a fixed position while the midportion of the lever bears against a boss 47 on the outboard side of the disc 41. Connected to the lower end portion of the lever 46 is a chain 49 which is operably connected with a manual speed adjusting mechanism having a hand crank 50 and an indicating dial 51. When the hand crank is turned in one direction, the chain 49 is pulled and serves to rock the lever 46 in a counterclockwise direction (FIG. 2) on the shaft 25 with the upper end of the lever serving as a fulcrum point. As a result of such rocking, the midportion of the lever is shifted toward the disc 41 and serves to slide that disc toward the fixed disc 40 so as to increase the effective diameter of the pulley 26 and to pull the belt 27 upwardly. As the belt moves upwardly, it slides the disc 44 of the pulley 29 outwardly against the bias of the spring 45 so as to decrease the effective diameter of the pulley 29. Accordingly, the speed of rotation of the shaft 30, and thus the drum 15, may be increased manually by turning the hand crank 50 in a direction to pull on the chain 49 and to rock the lever 46 counterclockwise, the dial 51 serving to indicate the speed of rotation of the drum.

If the hand crank 50 is turned in the opposite direction, the chain 49 relaxes to allow the lever 46 to rock in a clockwise direction and relieve the pressure on the disc 41 of the pulley 26. The tension in the belt 27 thus forces the disc 41 away from the disc 40 to decrease the effective diameter of the pulley 26 and, at the same time, the spring 45 forces the disc 44 of the lower pulley 27 toward the disc 43 to increase the effective diameter of the lower pulley and to maintain the tension in the belt. Thus, the hand crank 50 can be used to change the effective diameters of the pulleys and enables the operator of the machine 10 to manually set the drive mechanism 23 to rotate the drum 15 at a selected speed.

In setting up the machine 10, the operator usually adjusts the speed of the drum 15 such that the drum will supply slightly more wire 11 than is normally consumed by the cold header in the using station 20. The compensating arm 19 senses the difference between the speed at which the wire is being delivered from the drum and the speed at which the wire is being consumed by the cold header and, if such difference exceeds a predetermined value, the compensating arm momentarily shuts off the drive motor 24 until the excess wire is used by the cold header.

The compensating arm 19 comprises an elongated upright member 60 (FIG. 1) whose lower end is secured rigidly to one end portion of a horizontal shaft 61 which is journaled by the frame 14. A grooved wheel 63 is supported rotatably on the upper end portion of the member 60 and engages the loop **11*d* in the wire. The arm 19 is biased to swing in a clockwise direction (FIG. 1) and thus the wheel 63 tends to increase the size of the loop 11*d*. For this purpose, several contractile springs 64 are stretched between a projection 65 on the lower end portion of the member 60 and a plate 66 which is secured to the frame 14, the plate being adjustable in a vertical direction so as to enable the spring tension to be changed. Thus, the springs 64 urge the arm in a clockwise direction in order that the arm may take up the slack in the loop 11*d***.

If the loop **11*d* becomes excessively large, the arm 19 pivots to an extreme clockwise position and, in so pivoting, rocks the shaft 61 clockwise to cause a dog 70 (FIG. 2) on the shaft to engage and open a limit switch 71. Opening of the switch 71 de-energizes the drive motor 24 and stops the drum 15 from rotating so that the cold header can consume the excess wire and reduce the size of the loop 11*d*. As the loop decreases in size, it pivots the arm 19 in a counterclockwise direction against the bias of the springs 64 and, as the arm pivots, the dog 70 moves away from the limit switch 71 to re-start the motor and re-initiate rotation of the drum 15. Accordingly, the arm stops the drum when the loop becomes too large and thus prevents the wire from slipping on and galling the drum. The arm 19 can, however, be of disadvantage if it repeatedly opens and closes the switch 71 to stop and start the drive. Such repeated stopping and starting imparts severe shock loads to the entire drive train and tends to significantly shorten the service life of the machine 10. Also, swinging of the arm to extreme counterclockwise positions results in the springs 64 imparting a comparatively large degree of tension into the wire as it exits from the drum and is supplied to the feed rolls 21. Such exiting tension tends to pull the wire back from the feed rolls 21** and can result in detrimental operation of the cold header.

In accordance with one aspect of the present invention, the comparatively simple and inexpensive variable speed drive mechanism 23 is equipped with a unique speed trim control 73 which serves to automatically adjust the rotational speed of the drum 15 in accordance with the demands of the using station 20. By virtue of the speed trim control, the drum is rotated on a substantially continuous basis and is stopped only when the wire being consumed by the using station in less than that supplied by the drum at the lowest speed at which the drive mechanism can rotate the drum. Thus, repeated stopping and starting of the drive train is avoided so as to enable the use of a less rugged and lower cost drive train. Moreover, the automatic speed trim control 73 serves to keep the size of the loop **11*d*** substantially constant and thus a substantially constant and comparatively low exiting tension can be maintained in the wire supplied from the drum.

Figure 3:
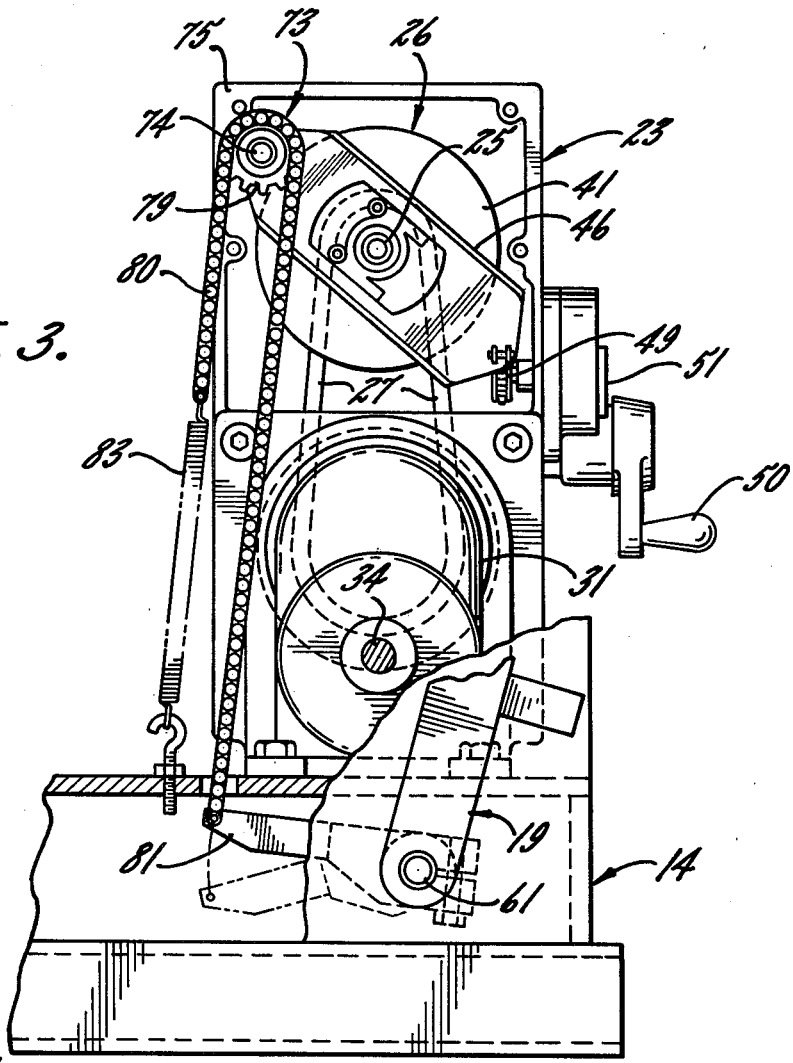
FIG. 3 is a fragmentary cross-section taken substantially along the line 3—3 of FIG. 2.

More specifically, the automatic speed trim control 73 responds to pivoting of the compensating arm 19 and serves to adjust the position of the disc 41 of the pulley 26. Herein, the speed trim control comprises an elongated ball screw 74 (FIG. 2) which extends loosely through the upper end portion of the shifting lever 46 and which is secured rigidly at one end to a housing 75 which encloses the pulleys 26 and 27. Telescoped slidably over the screw is a tube 76 having one of its ends disposed in engagement with the upper end portion of the shifting lever and normally defining the fulcrum for the lever. The other end of the tube is disposed in engagement with a ball nut 77 threaded on the screw and carrying a sprocket 79 (FIG. 3). A length of chain 80 is trained around the sprocket and is secured at one end to a projection 81 which is rigid with the same shaft 61 that is connected to the compensating arm 19. The other end of the chain 80 is connected to the upper end of a contractile spring 83 (FIG. 3) whose lower end is anchored to the frame 14. As shown in FIG. 3, the spring 83 urges the sprocket 79 and the ball nut 77 to turn in a counterclockwise direction and tends to cause the nut to thread away from the tube. In addition, the spring 83 urges the shaft 61 to turn in a clockwise direction and thus assists the springs 64 in biasing the compensating arm clockwise (FIG. 2) into engagement with the loop 11*d*.

To explain the operation of the automatic speed trim control 73, let it be assumed that the operator of the machine 10 has adjusted the hand crank 50 so as to cause the drive mechanism 23 to rotate the drum 15 at a speed at which the drum supplies just slightly more wire than is being consumed by the using station 20. As a result, the loop 11*d* tends to increase in size and permits the springs 64 and the spring 83 to pivot the compensating arm 19 clockwise, such pivoting resulting in clockwise turning of the shaft 61. As the shaft 61 turns, the spring 83 takes up the slack in the chain 80 and causes the chain to rotate the sprocket 79 and the nut 77 in a counterclockwise direction. Accordingly, the nut allows the tube 76 to move away from the shifting lever 46 so that the shifting lever leaves the disc 41 of the pulley 26 free to slide away from the disc 40. The effective diameter of the pulley 26 thus is reduced so as to reduce the output speed of the drive mechanism 23 and slow the rotational speed of the drum 15. Accordingly, the loop 11*d* normally is prevented from becoming so large as to permit the arm 19 to swing clockwise to a position in which the dog 70 would open the switch 71 and shut down the drive. Thus, the speed trim control 73 slows the drum to a speed at which the wire supplied by the drum is equalized with the wire consumed by the using station 20 and eliminates the need of repeatedly stopping and starting the drive motor 24. Of course, the compensating arm will swing sufficiently far to open the switch 71 if the demand of the using station 20 is so low that the loop 11*d* continues to increase in size even when the drive mechanism 23 is adjusted to operate at its slowest speed. In such an event, the drive to the drum is shut off before the exiting tension in the wire is lost and before the wire can slip excessively on and gall the drum.

The speed trim control 73 automatically increases the speed of the drum 15 if the using station 20 should happen to increase its demand or if the wire should happen to slip on the drum. If such circumstances occur, the loop 11*d* decreases in size and pulls the compensating arm 19 in a counterclockwise direction. The arm thus pulls on the chain 80 in such a direction as to impart clockwise rotation to the sprocket 79 and the nut 77 and to cause the nut to shift the tube 76 and the upper end of the shifting lever 46 toward the disc 41 of the pulley 26. That disc thus is shifted toward the disc 40 to increase the effective diameter of the pulley 26 and increase the speed of the drum 15. Accordingly, the drum supplies more wire to the using station 20 and, as a result, the loop 11*d* is prevented from swinging the arm counterclockwise so far that the springs 64 and the spring 83 impart excessive exiting tension to the wire in the loop. Thus, the exiting tension is kept low so as to minimize the pull back on the feed rolls 21.

Figure 4:
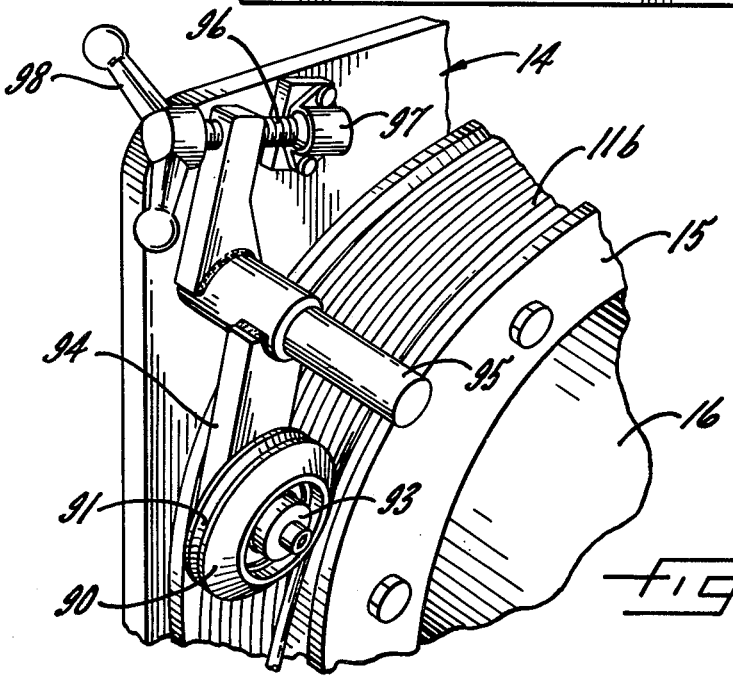
FIG. 4 is a perspective view showing the drum and the roller.

The present invention also contemplates the provision of extremely simple and inexpensive means for preventing the wire 11 from slipping on the drum 15. Herein, these means comprise a roller 90 (FIGS. 1 and 4) which holds the final wrap of wire against the exit end portion of the drum and prevents the wire from slipping backwards along the drum. The periphery of the roller 90 is formed with a circumferentially extending and substantially V-shaped groove 91 which receives the final wrap of the wire coil 11*b* and, in keeping with the invention, the roller is connected to the output member of a one-way clutch 93 such as a conventional sprag clutch. The clutch 93 permits the roller 90 to rotate in a direction opposite to the direction of rotation of the drum 15 but prevents the roller from rotating in the same direction as the drum. Accordingly, the roller may rotate to allow the wire to unwind from the drum but, if the wire tends to slip backwards, the clutch holds the roller against rotation and thus the roller pinches the final wrap of wire against the drum. With the final wrap being held by the roller, the wire coil 11*b* tends to wrap down tightly on the drum in a manner similar to a spring clutch. The wire thus is prevented from slipping and, as a result, maximum traction between the wire and the drum is obtained.

In the present instance, the clutch 93 is carried on the lower arm of a bellrank 94 which is pivotally mounted on a rod 95 projecting from the frame 14. A screw 96 is threadably connected to the upper arm of the bellcrank and is rotatably received by a bracket 97 mounted on the frame and having a universal joint (not shown) coupled to one end of the screw. By turning a hand wheel 98 on the other end of the screw, the bellcrank 94 may be pivoted about the rod 95 to adjust the pressure exerted on the drum 15 by the roller 90.

Because of the roller 90 and the clutch 93, slippage between the wire 11 and the drum 15 is reduced virtually to zero so that maximum traction not only is imparted to the wire by the drum but also minimum exiting tension is imposed on the wire by the compensating arm 19 and the feed rolls 21. As a result of the slip being virtually eliminated, the compensating arm 19 is more directly responsive to any difference in the speed of the wire being supplied from the drum and the wire being consumed by the using station 20 and is better able to accomplish its functions of trimming the speed and shutting off of the motor 24.

From the foregoing, it will be apparent that the present invention brings to the art a new and improved wire drawing machine 10 having a simple and inexpensive mechanical drive 23 whose speed is adapted to be adjusted automatically by the trim control 73 in order to avoid repeated stopping and starting of the drive and to allow the wire to exit from the drum under low tension. In addition, the roller 90 and the clutch 93 provide a low cost means for preventing slippage and increasing traction. Thus, the present machine is less complex and more economical to manufacture than prior machines of the same general type.

We claim:

1. Apparatus for drawing a length of wire through a die and for supplying the wire to a using station, and apparatus comprising a support, a drum rotatably mounted on said support, said drum having an entrance end portion for receiving the wire from the die and having an exit end portion from which the wire is supplied to the using station, there being a coil of wire wrapped around said drum between said entrance and exit end portions with said coil being composed of a number of wraps in a single layer, a variable speed drive mechanism for rotating said drum thereby a draw wire onto said entrance end portion and to supply wire off of said exit end portion, said drive mechanism comprising a motor, an input pulley connected to be rotated by said motor, an output pulley connected to rotate said drum, and an endless belt connected between said pulleys to transmit rotation from said input pulley to said output pulley, each of said pulleys being adjustable in effective diameter and being operable when adjusted to change the speed of said output pulley and said drum, means for enabling the effective diameters of said pulleys to be manually adjusted so as to cause said drum to rotate at a selected speed, a sensing arm pivoted on said support and engaging the wire being supplied from the exit end portion of said drum to said using station in such a manner as to form such wire into a loop, said arm increasing the size of said loop when pivoted in one direction and permitting the size of said loop to decrease when pivoted in the opposite direction, means for biasing said arm in said one direction, and means connected between said arm and at least one of said pulleys and operable to change the effective diameters of said pulleys to decrease the speed of said drum when said arm pivots in said one direction and to increase the speed of said drum when said arm pivots in said opposite direction.

2. Apparatus as defined in claim 1 in which said one pulley comprises two side-by-side discs with one of said discs being slidable toward and away from the other disc to change the effective diameter of said one pulley, said last-mentioned means comprising a screw on said support, a nut threaded onto said screw and operable when rotated to cause said one disc to slide relative to the other disc, and mechanism connected between said arm and said nut and operable to rotate said nut in response to pivoting of said arm.

3. Apparatus as defined in claim 1 further including a roller mounted on said support and engaging the wrap of wire on the exit end portion of said drum, and a one-way clutch connected to said roller and permitting said roller to rotate in a direction opposite to the direction of rotation of said drum while preventing said roller from rotating in the same direction as the drum whereby said roller prevents said wire from slipping on and uncoiling from said drum.

4. Apparatus for drawing a length of wire through a die and for supplying the wire to a using station, said apparatus comprising a support, a drum rotatably mounted on said support, said drum having an entrance end portion for receiving the wire from the die and having an exit end portion from which the wire is supplied to the using station, there being a coil of wire wrapped around said drum between said entrance and exit end portions with said coil being composed of a number of wraps in a single layer, a variable speed drive mechanism for rotating said drum thereby to draw wire onto said entrance end portion and to supply wire off of said exit end portion, means for manually adjusting the output speed of said drive mechanism thereby to cause said drum to be rotated at a selected speed, a sensing arm pivoted on said support and engaging the wire being supplied from the exit end portion of said drum to said using station in such a manner as to form such wire into a loop, said arm increasing the size of said loop when pivoted in one direction and permitting the size of said loop to decrease when pivoted in the opposite direction, means for biasing said arm in said one direction, means responsive to the position of said arm and operable to decrease the output speed of said drive mechanism when said arm pivots in said one direction and to increase the output speed of said drive mechanism when said arm pivots in said opposite direction, a roller mounted on said support and engaging the wrap of wire on the exit end portion of said drum, and a one-way clutch connected to said roller and permitting said roller to rotate in a direction opposite to the direction of rotation of said drum while preventing said roller from rotating in the same direction as the drum whereby said roller prevents said wire from slipping on and uncoiling from said drum.

5. Apparatus as defined in claim 4 further including a groove formed in and extending around said roller, said wire being received in said groove.

6. Apparatus for drawing a length of wire through a die and for supplying the wire to a using station, said apparatus comprising a support, a drum rotatably mounted on said support, said drum having an entrance end portion for receiving the wire from the die and having an exit portion from which the wire is supplied to the using station, there being a coil of wire wrapped around said drum between said entrance and exit end portions with said coil being composed of a number of wraps in a single layer, a variable speed drive mechanism for rotating said drum thereby to draw wire onto said entrance end portion and to supply wire off of said exit end portion, means for automatically adjusting the output speed of said drive mechanism in response to changes in the demand of said using station for wire, a roller mounted on said support and engaging the wrap of wire on the exit end portion of said drum, and a one-way clutch connected to said roller and permitting said roller to rotate in a direction opposite to the direction of rotation of said drum while preventing said roller from rotating in the same direction as the drum whereby said roller prevents said wire from slipping on and uncoiling from said drum.

* * * * *

Disclaimer 4,099,403.—*Richard A. Alcock* and *Robert M. Guthrie*, Rockford, Ill. IN-LINE WIRE DRAWING MACHINE. Patent dated July 11, 1978. Disclaimer filed Nov. 21, 1980, by the assignee, *Rockford Manufacturing Group, Inc.*

Hereby enters this disclaimer to claims 1 and 2 of said patent.

[*Official Gazette January 27, 1981.*]